US005954003A

United States Patent [19]

Beyer et al.

[11] Patent Number: 5,954,003

[45] Date of Patent: Sep. 21, 1999

[54] DIVIDING SINKER WITH MODULES FOR TUFTING TOOLS

[76] Inventors: Walter Beyer, Patternhof 30, D-52249 Eschweiler, Germany; Derek White, 206 Hoghton Lane, Higher Walton, Preston, Lancashire, PR5 4EH, United Kingdom

[21] Appl. No.: 08/945,685

[22] PCT Filed: Apr. 17, 1996

[86] PCT No.: PCT/DE96/00665

§ 371 Date: Mar. 30, 1998

§ 102(e) Date: Mar. 30, 1998

[87] PCT Pub. No.: WO96/34138

PCT Pub. Date: Oct. 31, 1996

[30] Foreign Application Priority Data

Apr. 28, 1995 [DE] Germany ..... 295 06 820 U

[51] Int. Cl.[6] ..... D05C 15/10

[52] U.S. Cl. ..... 112/80.45

[58] Field of Search ..... 112/80.45, 80.4, 112/80.6

[56] References Cited

U.S. PATENT DOCUMENTS

| | | | |
|---|---|---|---|
| 2,889,791 | 6/1959 | Fedevich | 112/80.45 |
| 3,485,195 | 12/1969 | Torrence | 112/80.45 X |
| 4,157,690 | 6/1979 | Lund et al. | 112/80.45 X |
| 4,170,949 | 10/1979 | Lund | 112/80.45 |
| 4,369,720 | 1/1983 | Beasley | 112/80.45 |
| 4,445,446 | 5/1984 | Beasley | 112/80.45 |
| 4,519,326 | 5/1985 | Green et al. | 112/80.45 |
| 5,295,450 | 3/1994 | Neely | 112/80.45 |

FOREIGN PATENT DOCUMENTS

| | | |
|---|---|---|
| 2835186 | 3/1979 | Germany . |
| 2266537 | 11/1993 | United Kingdom . |

*Primary Examiner*—Ismael Izaguirre
*Attorney, Agent, or Firm*—John C. Purdue; David C. Purdue

[57] ABSTRACT

In a bar with modules for tufting tools, in particular a needle bar with needle modules, in which the tufting tools (3) are cast at one end into a plate-shaped basic body (1) of the module, at least one groove (9) running horizontally is worked in the bar (4). There extends from a plane face (2) of each module at least one moulding (7; 8) which projects perpendicularly to this face (2) and which engages into the groove (9) of the bar (4) and, alone or jointly with further mouldings (7; 8), holds the respective module fixedly in terms of rotation in the bar (4).

11 Claims, 9 Drawing Sheets

DIVIDING SINKER WITH MODULES FOR TUFTING TOOLS

BACKGROUND OF THE INVENTION

1. Field of the Invention

Figure 2:
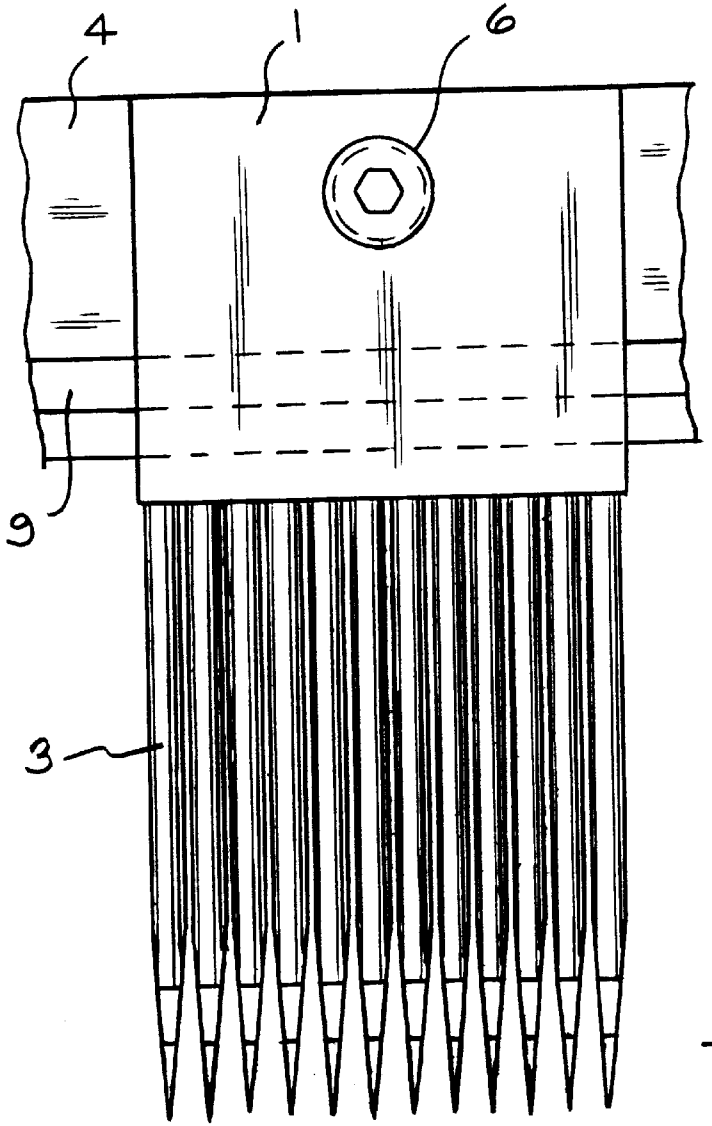

The invention relates to a bar with modules for tufting tools, in particular a needle bar with needle modules, in which the tufting tools are cast at one end into a plate-shaped module basic body, the length of which corresponds to a multiple of the centre-to-centre distance of the cast-in tufting tools and which has a plane face, bearing against the bar, and at least one continuous bore, through which a fastening screw can engage and be screwed into the bar.

2. Description of the Prior Art

It is known to cast a row of tufting, knitting or Raschel tools, for example needles or grippers, into a module basic body at exact locations and subsequently to fasten the modules, consisting of the tools and of the module basic body, to a bar, for example the needle bar of a tufting machine. For fixing to the bar, the module basic body is provided with a bore, through which a screw is led. A corresponding threaded hole is provided in the bar. In addition, there may be formed onto the module basic body a rectangular stop strip which is intended to fix the module in the direction of the bar and which transmits the force acting in the direction of the tools from the module to the bar.

Particularly in the case of longer tools and when working with racked stitches, the considerable yarn forces on the tools give rise to a torque which acts on the modules and which may be so great that rotation of the module occurs. Rotation, although being limited when a stop strip is present, is not prevented, since the stop strip, on account of its tolerances, allows the module to rotate, albeit only slightly.

Even this rotation is undesirable, since it leads to an uneven structure of the material produced by means of the tools, for example a tufting fabric. If the torque forces act in both directions, there is even a loosening of the module.

SUMMARY OF THE INVENTION

The object on which the invention is based is to design the modules or bars in such a way that rotation or loosening of a module is ruled out.

The object is achieved, according to the invention, in that at least one groove running horizontally is worked in the bar, and in that there extends from the plane face of each module at least one moulding which projects perpendicularly to this face and which engages into the groove of the bar and, alone or jointly with further mouldings, holds the respective module fixedly in terms of rotation in the bar.

In a way according to the invention, the arrangement may be designed in such a way that the moulding and the groove are rectangular in cross-section.

In a way according to the invention, the arrangement may also be designed in such a way that the moulding or mouldings has or have the form of a feather key and the groove or grooves has or have the form of a feather key groove.

In a way according to the invention, the arrangement may also be designed in such a way that the moulding and the groove are triangular in cross-section and, in addition, a further groove opening the front edge of the moulding is made on the groove bottom.

In a way according to the invention, the arrangement may also be designed in such a way that the moulding is trapezoidal in cross-section and the groove is triangular in cross-section.

In a way according to the invention, the arrangement may also be designed in such a way that the moulding or mouldings is or are formed on both sides of the module.

In a way according to the invention, the arrangement may also be designed in such a way that a collar annularly surrounding the bore is formed on the module on the side on which the said module comes to bear on the bar, the said collar engaging in a suitable recess coaxially surrounding a threaded blind hole of the bar.

In a way according to the invention, the arrangement may also be designed in such a way that the fastening screw has, in the region of the bore of the module, a threadless shank part, the diameter of which is larger than the diameter of the threaded part of the fastening screw.

In a way according to the invention, the arrangement may also be designed in such a way that the moulding or mouldings and the groove are worked as a locating fit.

In a way according to the invention, the arrangement may also be designed in such a way that the collar and the recess in the bar are worked as a locating fit.

In a way according to the invention, the arrangement may also be designed in such a way that the threadless shank part of the screw and the bore of the module are worked as a locating fit.

In a way according to the invention, the arrangement may also be designed in such a way that the moulding or mouldings is or are formed on the module by the injection-moulding method.

In a way according to the invention, the arrangement may also be designed in such a way that the groove is milled in.

The advantage of the invention is that the module is permanently fixed to the bar in all directions and the possibility of loosening is ruled out.

The invention will be explained in more detail with reference to several exemplary embodiments described below and illustrated in the accompanying drawing:

BRIEF DESCRIPTION OF THE DRAWING FIGURES

Figure 1:
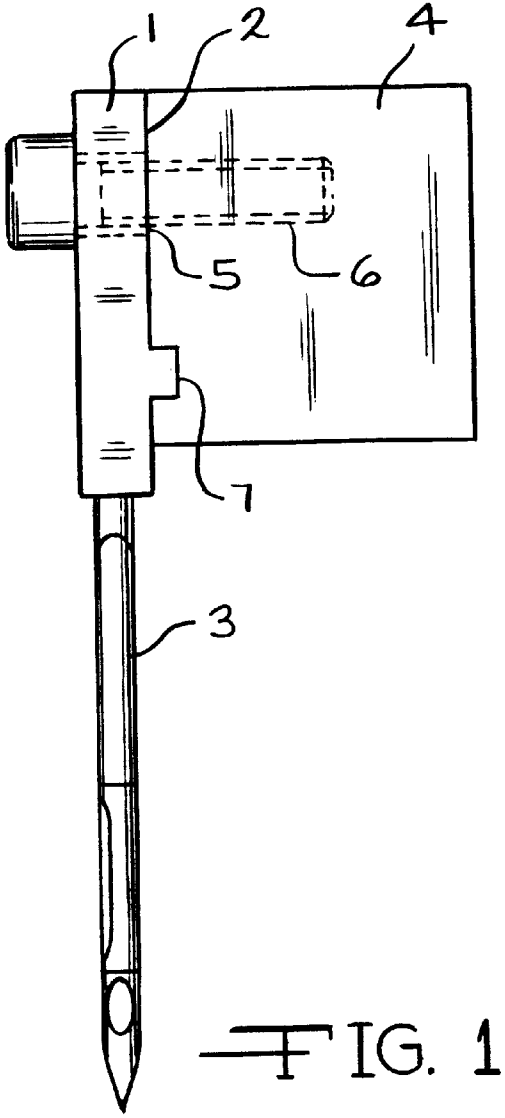
Figure 4:
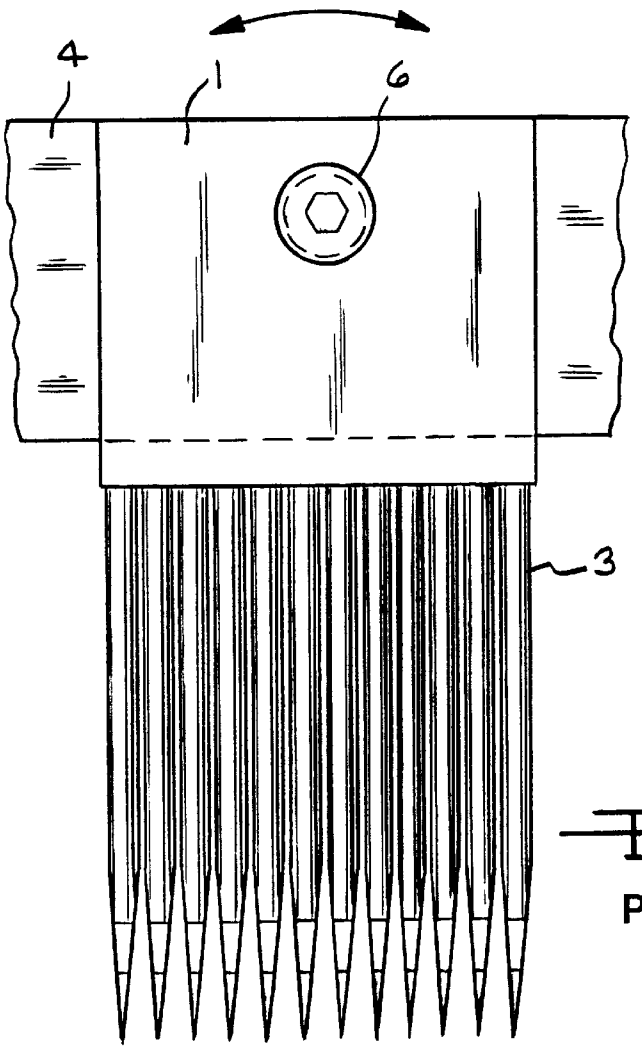
FIG. 4 PRIOR ART
Figure 3:
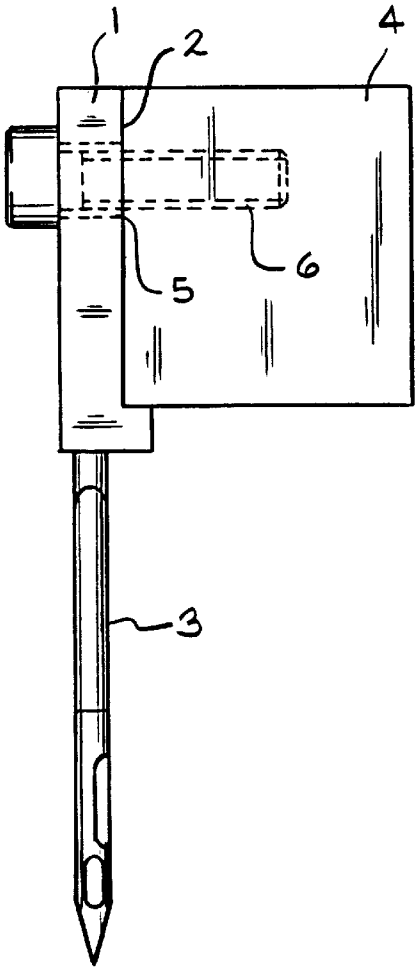
FIG. 3 PRIOR ART
Figure 6:
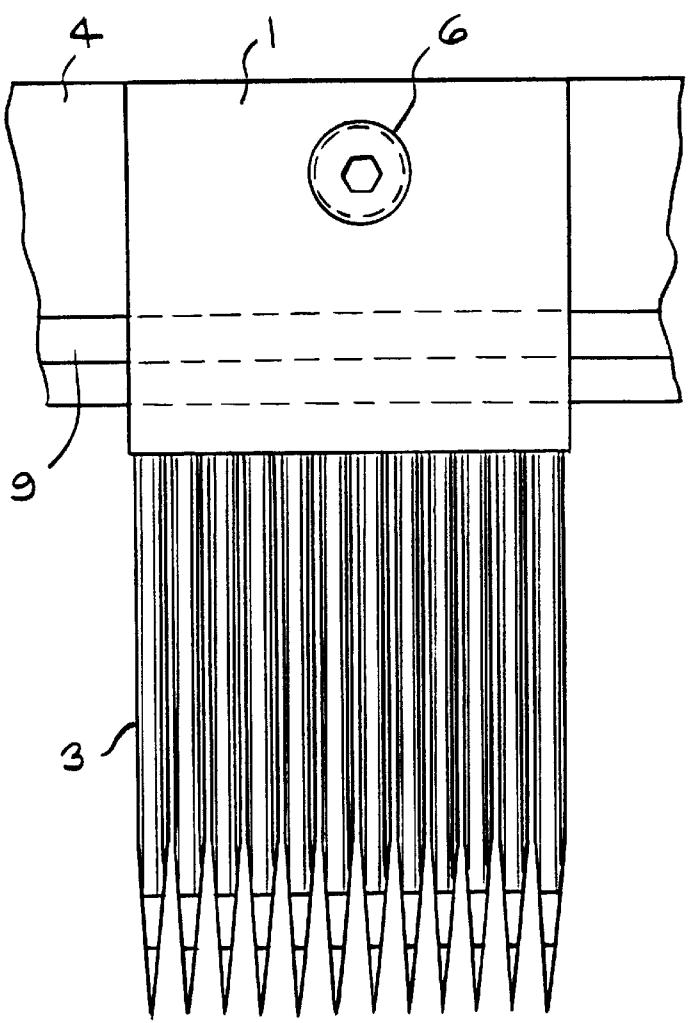
Figure 5:
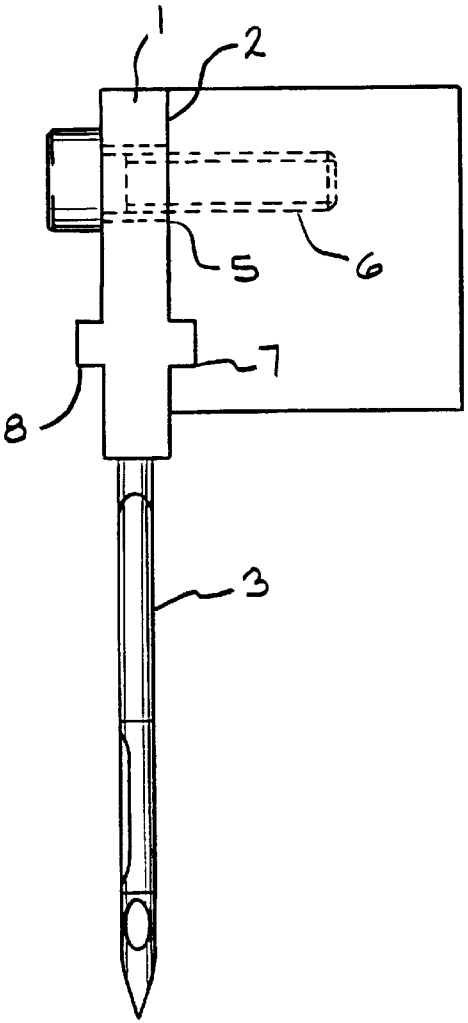
Figure 8:
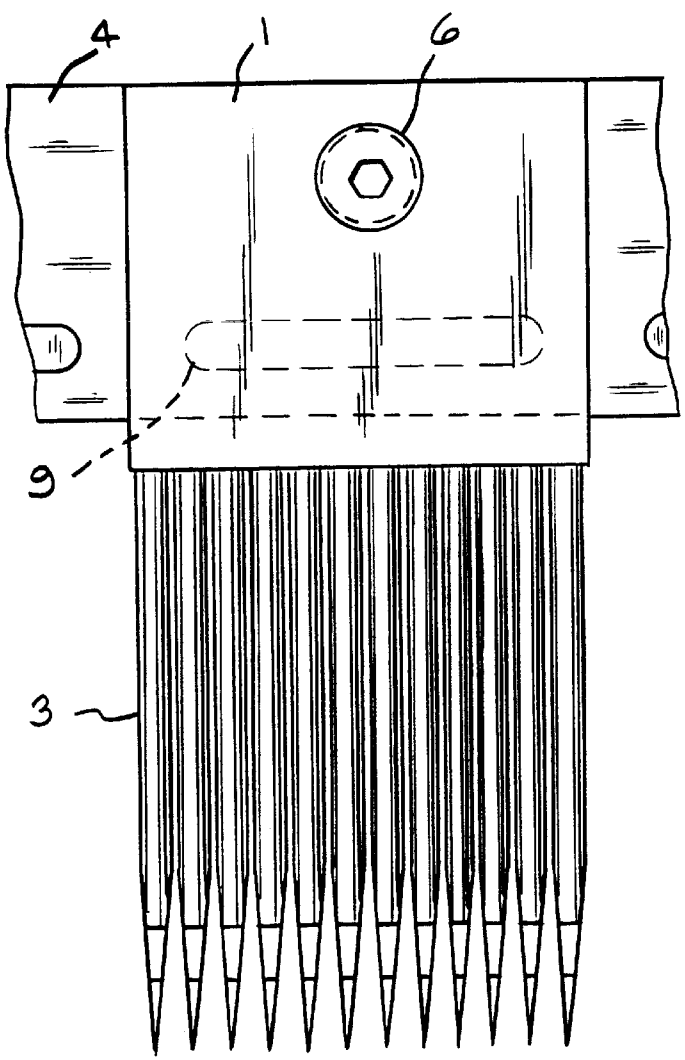
Figure 7:
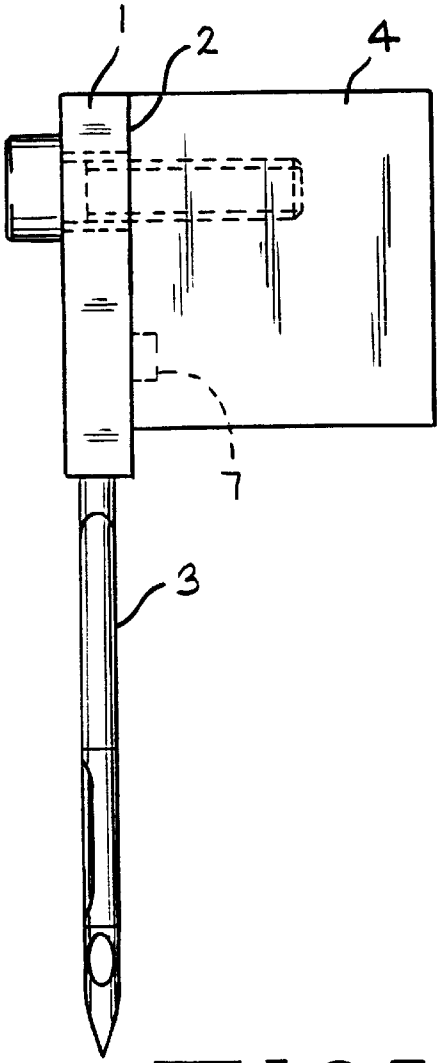
Figure 10:
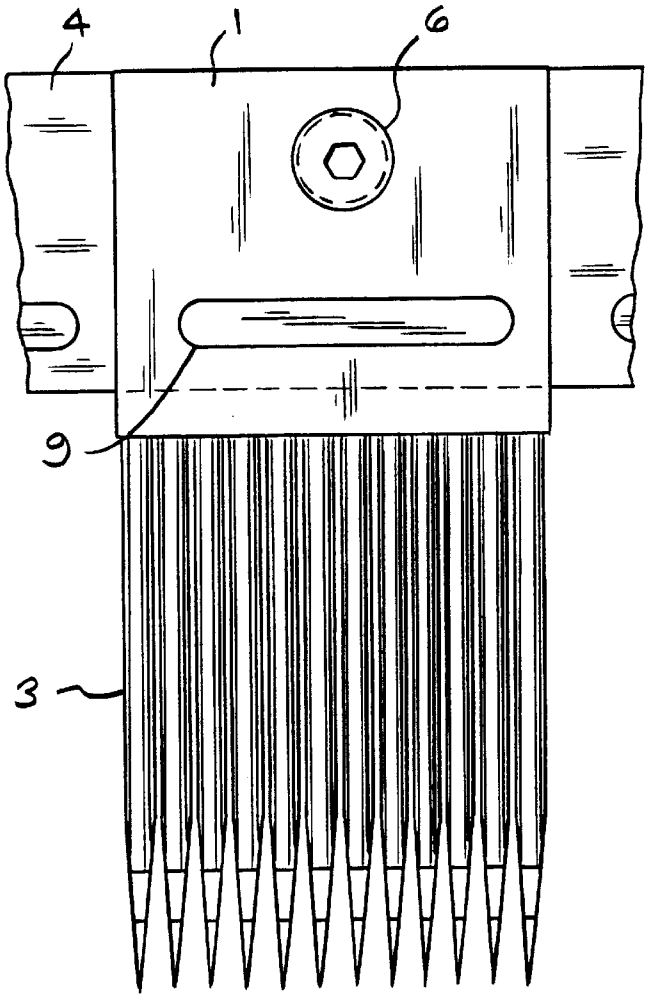
Figure 9:
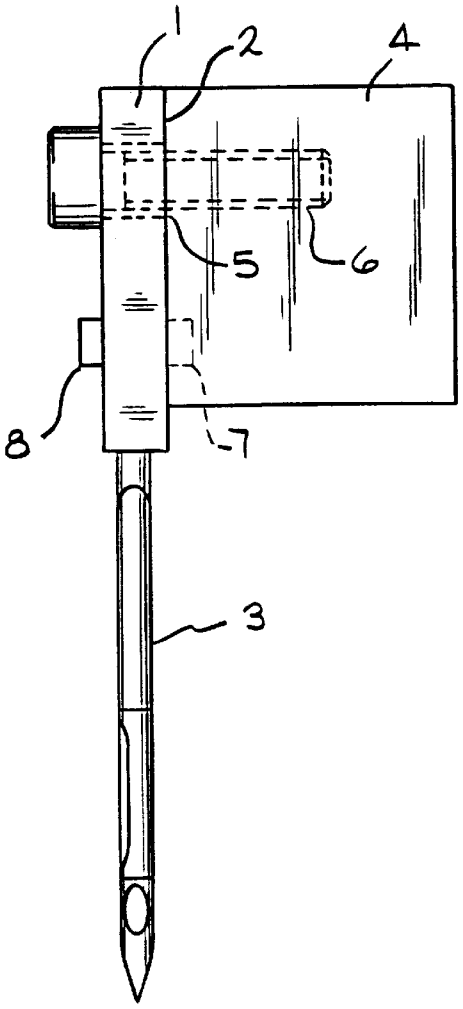
Figure 12:
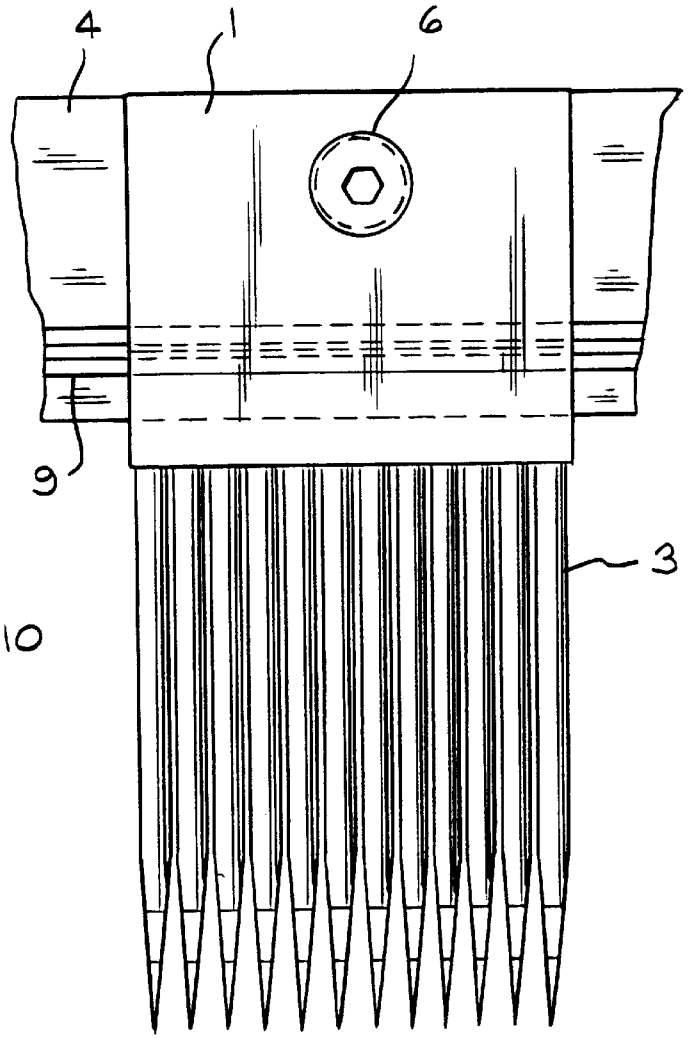
Figure 11:
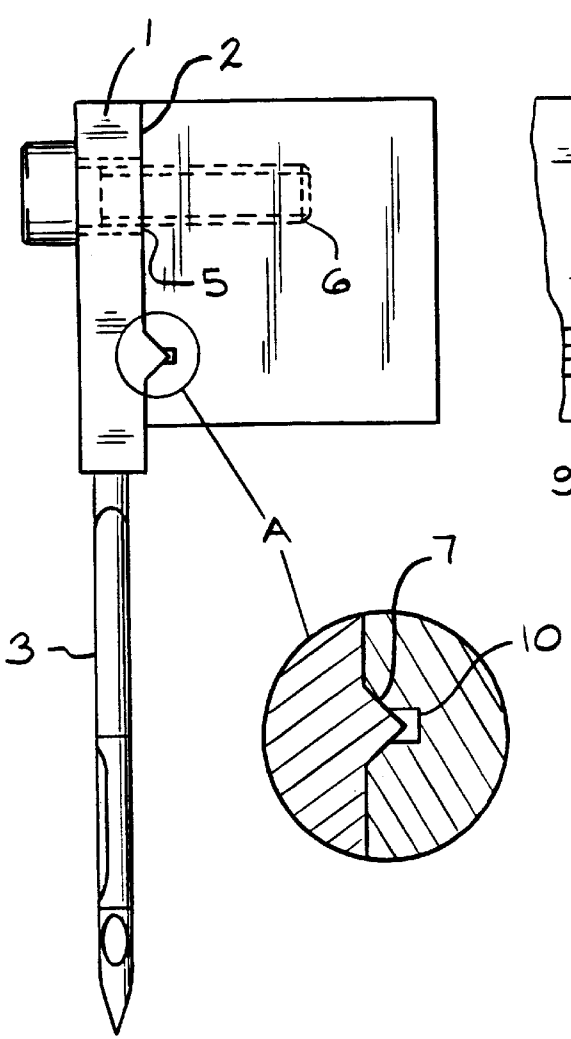
Figure 14:
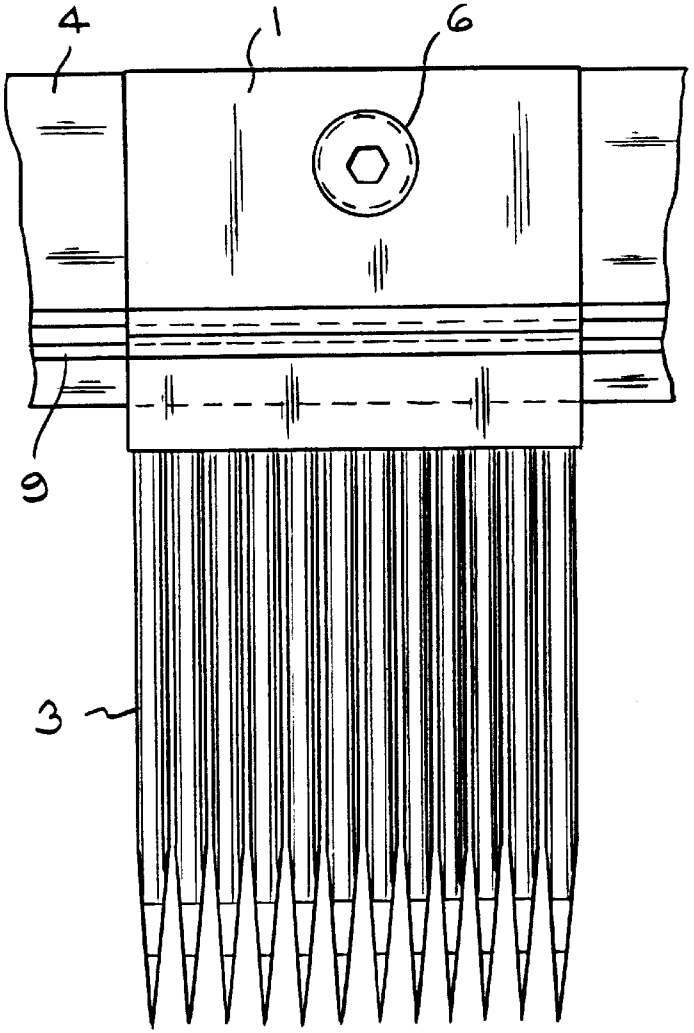
Figure 13:
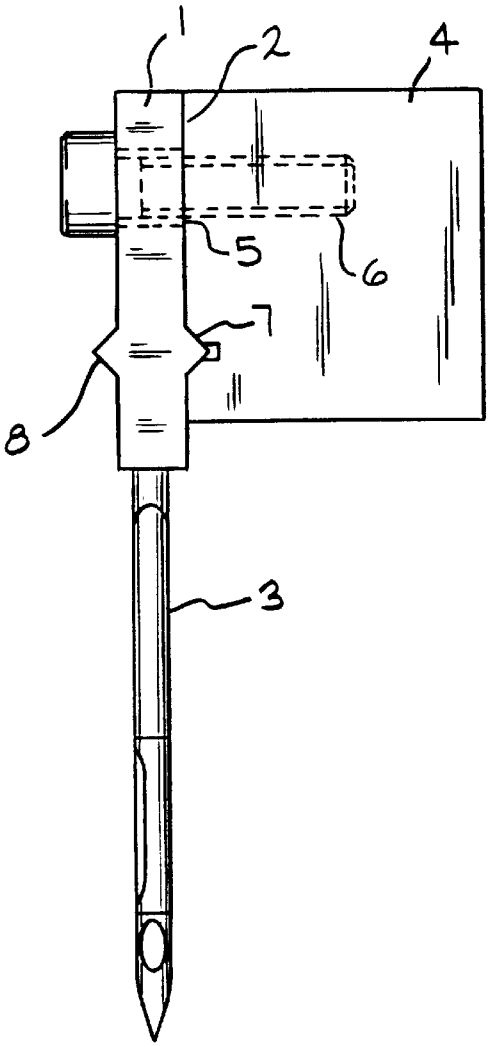
Figure 16:
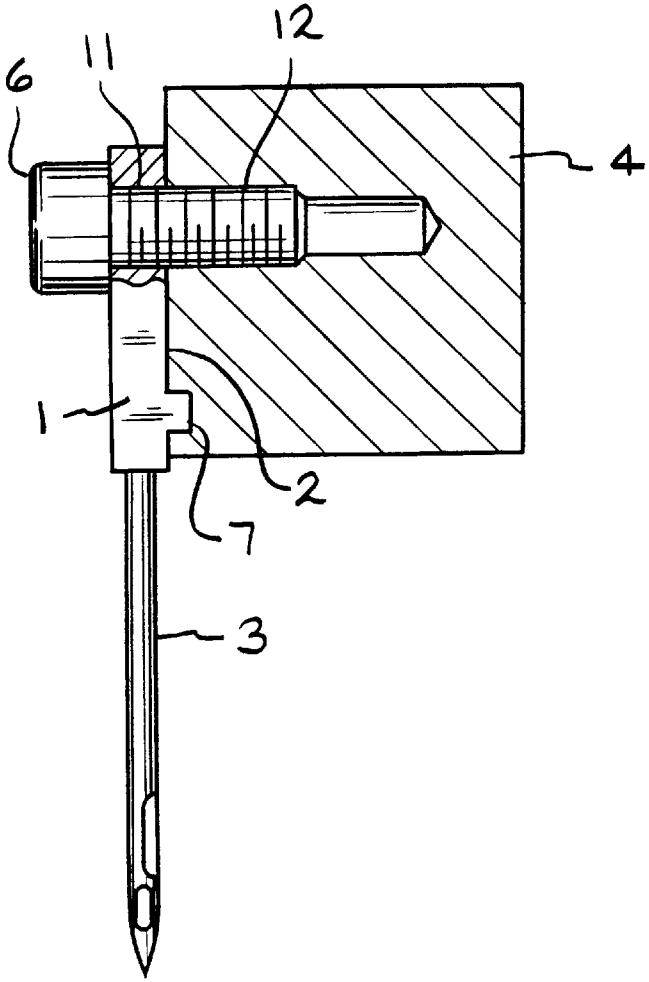
Figure 15:
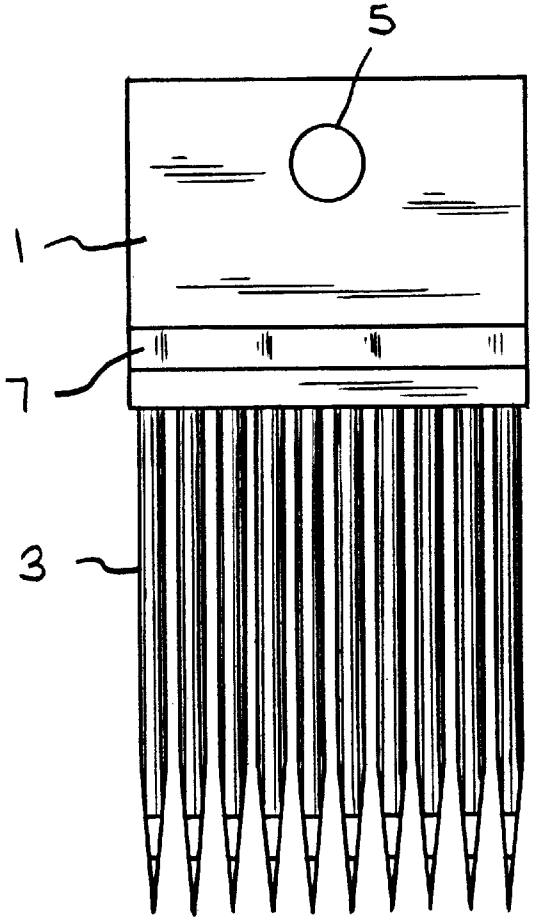
Figure 18:
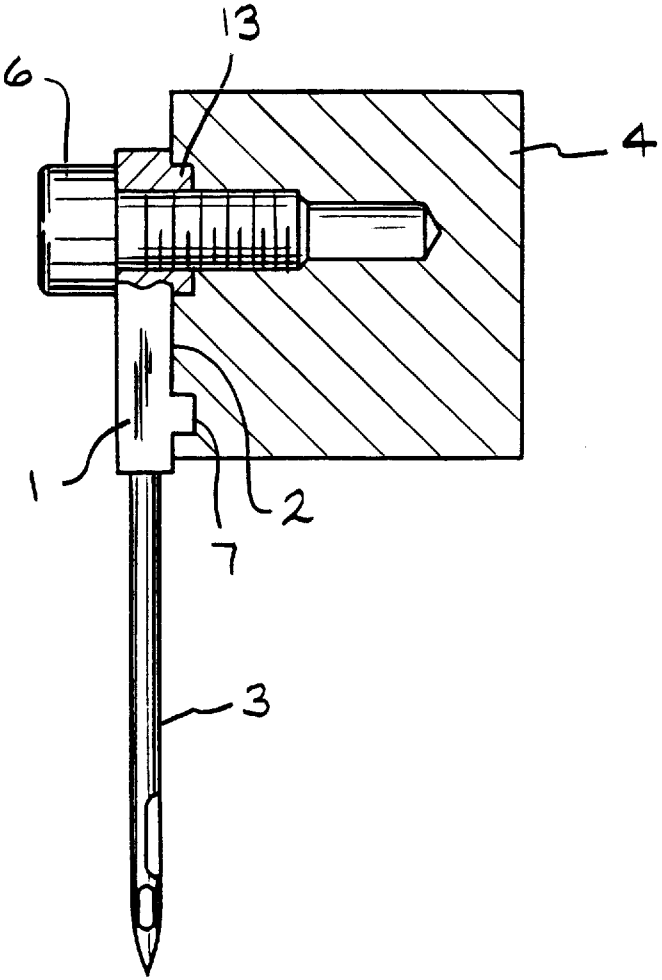
Figure 17:
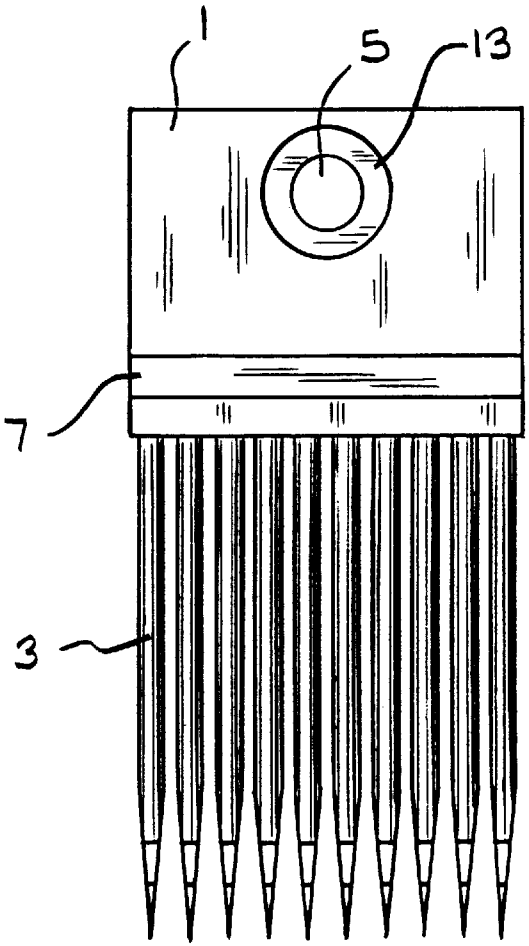

FIG. 1 is a side view of an embodiment of the invention with a rectangular strip formed according to the invention on the module, FIG. 2 is a front view of the arrangement according to FIG. 3, FIG. 3 is a side view of a conventional type of fastening of a needle module to a needle bar, FIG. 4 is a front view of the arrangement according to FIG. 3, FIG. 5 is a side view of an embodiment according to FIG. 1 with strips formed on the module on both sides, FIG. 6 is a front view of the arrangement according to FIG. 5, FIG. 7 is a side view of an embodiment according to FIG. 1 with a feather key groove in the bar, FIG. 8 is a front view of the arrangement according to FIG. 7, FIG. 9 is a side view of an embodiment according to FIG. 7 with strips formed on the module on both sides, FIG. 10 is a front view of the arrangement according to FIG. 9, FIG. 11 is a side view of a further embodiment of the invention with a strip of triangular cross-section, FIG. 12 is a front view of the arrangement according to FIG. 11, FIG. 13 is a side view of an embodiment according to FIG. 11 with strips formed on the module on both sides, FIG. 14 is a front view of the arrangement according to FIG. 13, FIG. 15 is a front view of a further embodiment of the invention, the fastening screw additionally having a locating connection to the module, FIG. 16 is a partially sectional side view of the arrangement according to FIG. 15, FIG. 17 is a front view of a further embodiment of the invention with a collar additionally formed on the module, and FIG. 18 is a partially sectional side view of the arrangement according to FIG. 17.

The module shown in the figures has a basic body 1 with a bearing face 2. The butts of tufting needles 3 are cast into the basic body 1. The module bears with the bearing face 2 against a needle bar 4. The basic body 1 is provided with a bore 5. The module is fastened to the needle bar 4 by means of a screw 6.

The axes of the tufting needles 3 lie parallel to one another in a plane of symmetry of the basic body 1.

FIG. 3 shows the conventional fastening of a needle module to a needle bar. The basic body 1 of the module has, at the lower end, a stop shoulder which projects relative to the bearing face 2 and which is intended to limit the movement of the module in the vertical direction. However, on account of the necessary tolerances, a slight rotation of the module may nevertheless occur, as indicated by the arrows in FIG. 4.

By contrast, FIG. 1 shows the version according to the invention. A moulding, here designed as a moulded strip 7, is located on the basic body 1 of the module. The moulded strip 7 is formed at the same time as the module is produced by the injection-moulding method. The moulded strip 7 projects into a corresponding groove 9 in the needle bar 4. FIG. 4 shows a needle bar 4 with a continuous longitudinal groove which can be milled into the bar by means of disk milling cutters. The groove 9 and the moulded strip 7 are worked as a locating fit.

The better the positive connection between the moulded strip 7 and the groove 9 in the needle bar 4, the more firmly the module is held.

FIGS. 5 and 6 show the same arrangement, the difference being that a further moulded strip 8 is formed on that side of the basic body 1 which is located opposite the present bearing face 2. The module can thus also be fastened to the needle bar 4 in a position rotated through 180°, with the position of the tufting needles 3 changing at the same time. A precondition is that that side of the module which is located opposite the bearing face 2 should likewise be designed in such a way that it again forms a bearing face when the arrangement of the module is reversed.

FIG. 7 shows a variant of the invention, in which the moulding has the form of a conventional feather key. A corresponding groove 9 in the needle bar 4 is suitably designed in the form of a feather key groove.

FIGS. 8 and 9 show, once again, the rotatably designed variant two mouldings 7 and 8 formed opposite one another on the basic body 1.

FIG. 11 shows another embodiment of the invention with a further cross-sectional shape of the moulded strip 7. Here, the moulded strip 7 has a triangular cross-section. The groove 9 in the needle bar 4 has the corresponding cross-sectional shape. So that the faces of the triangular moulded strip 7 can reliably come to bear on the flanks of the groove 9, a further rectangular groove 10, into which the tip of the triangular moulded strip 7 can project freely, is worked out on the groove bottom.

FIGS. 13 and 14 show, once again, a corresponding design of the needle module with moulded strips 7 and 8 formed on both sides.

FIGS. 15 and 16 show a further variant of the invention. In addition to the locating fit between the moulded strip 7 and the corresponding groove 9 in the needle bar 4, a locating fit between the bore 5 in the basic body 1 of the needle module and the screw 6 is provided. The screw 6 has a threadless shank part 11, the cross-section of which is larger than the cross-section of the threaded part 12. The bore 5 and shank part 11 are worked out as a locating fit.

Alternatively to this, according to FIGS. 17 and 18 a collar 13 may also be formed on the basic body 1 of the needle module, the said collar engaging with a fit into a corresponding recess in the needle bar 4, the said recess coaxially surrounding the threaded bore in the needle bar 4.

The embodiments described have all been illustrated and described only in connection with tufting needles. Instead of needles, however, the arrangement may also extend to other tools, for example loopers and grippers.

We claim:

1. A bar with modules for tufting tools, said bar comprising a first face and a composite, horizontally extending groove formed in said first face of said bar, said modules comprising a module body, tufting tools cast into an end of the module body, a first plane face and a second plane face, said module being provided with at least one continuous bore extending through said module from said first plane face to said second plane face, said module further comprising a first moulding extending from said first plane face and a second moulding extending from said second plane face, said first and second mouldings being operable, when either one engages the groove formed in said bar and a fastening screw passing through the bore in said module is screwed into said bar, to hold said module fixed against rotation relative to said bar.

2. The bar with modules claimed in claim 1 wherein said groove and said first and second mouldings have rectangular cross sections.

3. The bar with modules claimed in claim 2 wherein said modules further comprise a collar positioned annularly around the bore and extending from said first plane face, wherein a threaded blind hole is provided in said bar and wherein a recess is provided in said bar, coaxially surrounding the recess, for receiving said collar.

4. The bar with modules claimed in claim 1 wherein said groove has the form of a feather key groove and said first and second mouldings have the form of feather key.

5. The bar with modules claimed in claim 4 wherein said modules further comprise a collar positioned annularly around the bore and extending from said first plane face, wherein a threaded blind hole is provided in said bar and wherein a recess is provided in said bar, coaxially surrounding the recess, for receiving said collar.

6. The bar with modules claimed in claim 1 wherein said modules further comprise a collar positioned annularly around the bore and extending from said first plane face, wherein a threaded blind hole is provided in said bar and wherein a recess is provided in said bar, coaxially surrounding the recess, for receiving said collar.

7. A bar with modules for tufting tools, said bar comprising a first face and a composite, horizontally extending groove formed in said first face of said bar, said groove having a first portion, adjacent to said first face, which is triangular in cross section and a second portion extending from said first groove portion further into said bar, said modules comprising a module body, tufting tools cast into an end of the module body, and a first plane face, said module being provided with at least one continuous bore extending through said module from said plane face to an opposed face, said module further comprising a first moulding extending from said first plane face, said moulding having a triangular cross section and being operable, when it engages the groove formed in said bar and a fastening screw passing through the bore in said module is screwed into said bar, to hold said module fixed against rotation relative to said bar.

8. The bar with modules claimed in claim 7 wherein said modules further comprise a second plane opposite said first plane face and a second moulding having a triangular cross section extending from said second plane face, opposite said first moulding.

9. The bar with modules claimed in claim 7 wherein said modules further comprise a collar positioned annularly around the bore and extending from said first plane face, wherein a threaded blind hole is provided in said bar and wherein a recess is provided in said bar, coaxilly surrounding the recess, for receiving said collar.

10. The bar with modules claimed in claim 8 wherein said modules further comprise a collar positioned annularly around the bore and extending from said first plane face, wherein a threaded blind hole is provided in said bar and wherein a recess is provided in said bar, coaxially surrounding the recess, for receiving said collar.

11. The bar with modules claimed in claim 6, 3, 5, 9 or 10 wherein said collar and the recess in said bar have a cooperating fit which positively locates said module relative to said bar.

* * * * *